US006354821B1

(12) United States Patent
Hahn et al.

(10) Patent No.: US 6,354,821 B1
(45) Date of Patent: Mar. 12, 2002

(54) SCROLL COMPRESSOR WITH DUAL CLUTCH CAPACITY MODULATION

(75) Inventors: Gregory W. Hahn; Carlos Zamudio, both of Arkadelphia, AR (US); Joe T. Hill, Bristol, VA (US); Zili Sun, Arkadelphia, AR (US); Jason Hugenroth, Hope, AR (US); Thomas Barito, Arkadelphia, AR (US); John R. Williams, Bristol, VA (US); James W. Bush, Skaneateles, NY (US)

(73) Assignee: Scroll Technologies, Arkadelphia, AK (US)

( * ) Notice: Subject to any disclaimer, the term of this patent is extended or adjusted under 35 U.S.C. 154(b) by 0 days.

(21) Appl. No.: 09/718,918

(22) Filed: Nov. 22, 2000

(51) Int. Cl.[7] ..... F01C 1/02
(52) U.S. Cl. ..... 418/55.1; 418/69
(58) Field of Search ..... 418/55.1, 69

(56) References Cited

U.S. PATENT DOCUMENTS 1,268,350 A * 6/1918 Henry ..... 475/269
1,840,877 A * 1/1932 Rayburn ..... 418/69
2,467,627 A * 4/1949 Olson ..... 74/368
2,588,187 A * 3/1952 Weiser ..... 475/301
3,817,664 A * 6/1974 Bennett et al. ..... 418/55.1
3,874,827 A * 4/1975 Young ..... 418/55.1
4,137,798 A 2/1979 Sisk

FOREIGN PATENT DOCUMENTS

GB 2339853 * 9/2000 ..... 418/55.1
JP 01-290992 A * 11/1989 ..... 418/69

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A simplified drive arrangement is provided to allow a scroll compressor to be operated at two capacity levels by a reversible electric motor. A pair of one-way clutches are positioned on a pair of parallel shafts. When the motor is driven in a forward direction drive passes through one of the one-way clutches and directly to the orbiting scroll. However, when the motor is driven in a reverse direction, drive passes through a countershaft, which in turn passes through a second one-way clutch. The drive passing through the second one-way clutch will result in the orbiting scroll being driven at a distinct speed then when the motor is driven in a reverse direction. In this way, capacity modulation is achieved with a very simple mechanism.

3 Claims, 1 Drawing Sheet

SCROLL COMPRESSOR WITH DUAL CLUTCH CAPACITY MODULATION

BACKGROUND OF THE INVENTION

This invention relates to a simplified clutch mechanism for providing capacity modulation in a scroll compressor through a simplified arrangement.

Scroll compressors are becoming widely utilized in refrigerant compression applications. In a scroll compressor a pair of scroll members each include a base with a generally spiral wrap extending from the base. The wraps interfit to define compression chambers. One of the two wraps is caused to orbit relative to the other, and the compression chambers decrease in volume. One limitation on scroll compressors is that the orbital direction must be in a single direction of movement. Thus, if the orbiting movement is caused by driveshaft rotation in a forward direction the scroll compressor will operate properly. On the other hand, if the shaft should be driven in a reverse direction such that the scroll member orbits in a reverse direction the results would be undesirable. For this reason, it has generally been a goal of scroll compressor designers to eliminate any occurrence of rotation in a so-called reverse direction.

One other goal of compressor designers is to provide the ability to change, or modulate, the capacity of the compressor. One method of achieving capacity modulation is to vary the amount or volume of refrigerant being compressed.

Compressors have been proposed wherein clutch mechanisms including planetary drives are positioned between the drive motor and the orbiting scroll. When the drive motor is driven in a first direction the orbiting scroll is caused to orbit in a forward direction. However, when the motor is driven in an opposed direction the shaft passes through the planetary transmission such that a distinct speed in a forward direction is achieved. By providing the two different speeds, capacity modulation is achieved. Moreover, the planetary drive and the clutch mechanisms are arranged such that the drive to the orbiting scroll causes the orbiting scroll to orbit in a forward direction regardless of the rotation direction of the motor. While these proposed arrangements show promise, they are somewhat complicated.

SUMMARY OF THE INVENTION

In the disclosed embodiment of this invention, the driveshaft of a scroll compressor motor extends along a driveshaft into a first one way clutch. If the driveshaft and clutch are driven in a first forward direction then the clutch passes this rotation along to the mechanism for driving the orbiting scroll directly. Thus, during normal operation the driveshaft is driven in the forward direction and the one-way clutch passes the rotation on to the mechanism for driving the orbiting scroll. The scroll compressor operates in a normal fashion.

A counter-gear is engaged with a gear on the driveshaft "upstream" of the one-way clutch on the driveshaft. The counter-gear is caused to rotate in an opposed direction to that of the driveshaft. A countershaft is driven by the counter-gear. Thus, when the driveshaft is driven in the forward direction, the counter-gear is driven in an opposed direction. A one-way clutch is positioned on the countershaft and serves to not pass rotation from a first countershaft portion to a second countershaft portion when the driveshaft is driven in the forward direction. The second countershaft portion drives another counter gear which is preferably engaged with an idler gear, and which further drives another gear on a second driveshaft portion which is downstream of the first one-way clutch.

Now, when the motor is driven in a forward direction, drive passes through the first one-way clutch and directly to the mechanism for driving an orbiting scroll. The countershaft is driven in a reverse direction and the first countershaft portion rotates in that direction. When driven in a reverse direction, the second one-way clutch allows slipping movement, and thus the second countershaft portion is not driven by the first countershaft portion. Instead, the downstream gear on the main driveshaft drives the idler gear and the second countershaft portion. However, the second one-way clutch accommodates the relative rotation of the first and second countershaft portions.

When the motor is driven in a reverse direction, then the first one-way clutch does not drive the first and second driveshaft portions together, but instead allows slippage. In this case, the counter-gear and thus the first countershaft portion are now driven in a forward direction. This in turn causes the second countershaft portion to be driven through the second one-way clutch by the first countershaft portion. Drive then passes through the idler gear back to the driveshaft and eventually to the orbiting scroll in a proper forward direction. The gear ratios of the several gears can be controlled to achieve desired capacity modulation when the motor is driven in the two directions.

These and other features of the present invention can be best understood from the following specification and drawings, the following of which is a brief description.

BRIEF DESCRIPTION OF THE DRAWINGS

The sole FIGURE is a schematic view of a transmission for driving an orbiting scroll at two distinct speeds to achieve capacity modulation.

DETAILED DESCRIPTION OF A PREFERRED EMBODIMENT

Figure 1:
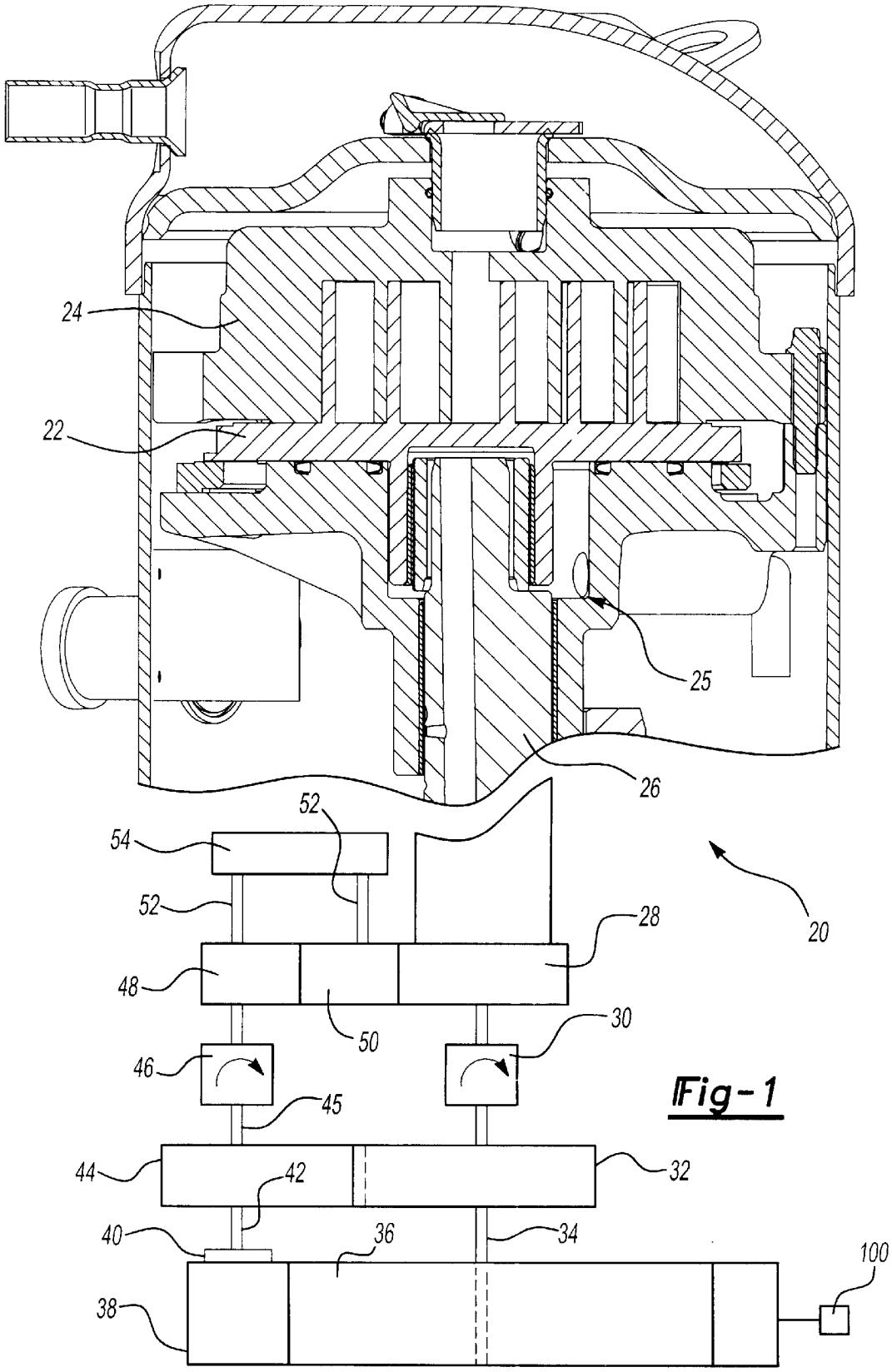

The scroll compressor 20, shown schematically, includes an orbiting scroll 22 being driven to orbit relative to a non-orbiting scroll 24. A mechanism 25 includes a slider block, eccentric pin, Oldham coupling, etc. as is known. Other means of causing the orbiting scroll to orbit may be substituted, and the above description is supplied merely as an example. The driveshaft 26 causes the orbiting scroll to orbit through its mechanism 25. A downstream driveshaft gear 28 is driven through a first one-way clutch 30 when drive passes from a driveshaft portion 34 and an upstream driveshaft gear 32. A motor rotor 36 and a motor stator 38 are as known. A mount structure 40, shown schematically adjacent stator 38, includes a mount pin 42 for mounting a counter-gear 44. Counter-gear 44 drives a first countershaft portion 45, which drives through a second one-way clutch 46. The second one-way clutch 46 drives a second countershaft portion and second countershaft gear 48. The second countershaft gear 48 drives an idler gear 50 which is in turn engaged with the upstream driveshaft gear 28. Mount pins 52 mount within a mount structure 54, again shown schematically.

As mentioned above, when it is desired to operate the scroll compressor at one capacity level, the motor is driven in a forward direction. When driven in a forward direction, drive will pass directly along the shaft 34, through the one-way clutch 30, into shaft 26 and drive the orbiting scroll 22 in the proper direction. However, when it is desired to achieve a distinct capacity, the motor is caused to be driven in a reverse direction. When driven in this direction, the counter-gear 44 rotates in an opposed direction to that of the gear 32. The one-way clutch 46 which is preferably similar to the first one-way clutch 30 would pass rotation from countershaft portion 45 to the countershaft 48 when the countershaft portion 45 is driven in the same direction (forward). Thus, when the shaft 34 is driven in a reverse direction drive will pass from the countershaft portion 45 to drive the gear 48, the idler gear 50, and the gear 28. Thus, when driven at the second capacity level, the drive will pass through the gear 44, shaft 45, gear 48, idler gear 50, and gear 28 to the shaft portion 26.

As shown a motor control 100 drives the motor, and determines which of the two capacities is desirable. The control may be provided with inputs from various system and compressor sensors to make the determination of which capacity is most desirable.

The size of the various gears can be controlled to achieve desired capacity levels between the two. That is, it may be desirable that when the motor is driven in a reverse direction the final speed of the shaft is greater than the nominal motor speed. Alternatively, and generally, it is desirable that the final output of the speed when the motor is driven in a reverse direction will be less than the nominal speed when the motor is driven in a forward direction.

A preferred embodiment of this invention has been disclosed, however, a worker in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from the base;

a second scroll member having a base and a generally spiral wrap extending from its base;

a driveshaft driven by a reversible electric motor, said driveshaft being operable to cause said second scroll member to orbit, said driveshaft being driven by said motor;

said driveshaft being connected to a first one-way clutch, such that when said driveshaft is driven in a direction which is a proper direction for driving said second scroll member, said first one-way clutch will pass rotation from said driveshaft to said second scroll member;

a countershaft gear rotating with a first countershaft portion, said countershaft gear engaged with an upstream gear on said driveshaft, said upstream gear being positioned between said first one-way clutch and said motor, said countershaft gear driving said first countershaft portion, which drives a second one-way clutch, said second one-way clutch driving a second countershaft portion when said first countershaft portion is rotated in said forward direction, and a second countershaft gear operably driving a downstream driveshaft gear when said first countershaft portion is driven in said first direction, such that said second scroll member is driven said first direction when said motor is driven in said forward and said reverse directions.

2. A scroll compressor as recited in claim 1, wherein an idler gear is positioned between said second countershaft gear and said downstream driveshaft gear.

3. A scroll compressor as recited in claim 1, wherein said upstream gear and said downstream gear provide a gear ratio which drives said second scroll at distinct speeds when said motor is driven in said forward and said reverse directions.

* * * * *